US005249876A

United States Patent [19]

Hattman

[11] Patent Number: 5,249,876

[45] Date of Patent: Oct. 5, 1993

[54] CAULKING NOZZLE

[76] Inventor: Harold M. Hattman, 104 Nyetimber Pkwy., Coraopolis, Pa. 15108

[21] Appl. No.: 791,463

[22] Filed: Nov. 13, 1991

Related U.S. Application Data

[63] Continuation of Ser. No. 621,326, Dec. 3, 1990, abandoned.

[51] Int. Cl.[5] ..... B65D 25/40; B65D 25/42; B65D 25/48

[52] U.S. Cl. ..... 401/261; 222/566; 401/266; 425/87

[58] Field of Search ..... 401/261, 265, 266; 222/541, 566, 567, 568; 425/87

[56] References Cited

U.S. PATENT DOCUMENTS

| | | | |
|---|---|---|---|
| 760,027 | 5/1904 | Selley | 425/87 |
| 2,952,861 | 8/1960 | Reggio | 15/135 |
| 3,133,300 | 5/1964 | Freeman | 15/236 |
| 3,256.980 | 6/1966 | Ball | 401/75 |
| 3,536,411 | 10/1970 | Eisert | 401/176 |
| 3,627,435 | 12/1971 | Hendershot | 401/265 |
| 3,653,560 | 4/1972 | Adams et al. | 222/566 |
| 4,258,884 | 3/1981 | Rogers | 239/390 |
| 4,260,273 | 4/1981 | Hemperly, Jr. et al. | 401/48 |
| 4,284,213 | 4/1981 | Lee | 222/541 |
| 4,380,425 | 4/1983 | Edelman | 425/458 |
| 4,570,834 | 2/1986 | Ward | 222/566 |
| 4,872,778 | 10/1989 | Longo | 401/266 |
| 4,946,081 | 8/1990 | Jacobson | 222/568 |
| 4,957,225 | 9/1990 | Childers | 222/568 |
| 4,981,629 | 1/1991 | Cook | 264/33 |

FOREIGN PATENT DOCUMENTS

| | | | |
|---|---|---|---|
| 48548 | 10/1889 | Fed. Rep. of Germany | 425/87 |
| 1320730 | 2/1963 | France | 425/87 |
| 18909 | 7/1903 | Sweden | 425/87 |

*Primary Examiner*—Steven A. Bratlie
*Attorney, Agent, or Firm*—Buchanan Ingersoll; Michael L. Dever

[57] ABSTRACT

A nozzle for applying filler material to a corner surface is provided having a generally cylindrical barrel. One end of the barrel has three beveled surfaces which taper to form a triangular spear shape. A central bore extends longitudinally throughout the extent of the barrel and forms a tip opening at the tapered end and a supply opening at the opposite end. Filler material proceeds through the central bore and out the tip opening on to the surface to which it is applied.

6 Claims, 1 Drawing Sheet

CAULKING NOZZLE

This application is a continuation of application Ser. No. 621,326, filed Dec. 3, 1990, now abandoned.

BACKGROUND OF THE INVENTION

1. Field of the Invention

This invention relates to the field of nozzles for the distribution of filler material. More particularly, the invention relates to an improved nozzle for distributing caulking compound between adjacent perpendicular surfaces.

2. Description of the Prior Art

Typical nozzles for applying filler material, such as caulking material, to a surface have been either conical or slightly tapered cylindrical in shape. A hollow channel axially provided in the nozzle directs the filler material to the surface to which it is to be applied. Although excellent for applying filler material to a flat surface, such nozzles fail to adequately fill a corner formed from adjacent, perpendicular surfaces. Moreover, such nozzles do not produce a smooth even flow of filler material.

An attempt to provide a nozzle for supplying filler material between adjacent surfaces is shown in Hendershot, U.S. Pat. No. 3,627,435. Therein, a nozzle is provided having essentially four beveled surfaces surrounding an applicator tip. Two of the four beveled surfaces form a pair of opposed angular cheeks which control the side to side movement of the nozzle, control the vertical depth of the nozzle aperture in the void to be filled, and control the formation of a seal between the adjacent contiguous surfaces which form the void to be filled. A third beveled surface permits the nozzle to follow the line of application of filler material and depresses any previously filled voids which intersect at an angle. The fourth beveled surface permits the tip to strike the exposed surface of the filler material clean as the nozzle progresses within the void to be filled. Although the nozzle of Hendershot solves the problem of supplying filler material between adjacent surfaces, the nozzle has a very complicated geometry which render it difficult to manufacture. Consequently, there is a need for a nozzle design having a simpler geometry which is easy to manufacture and which permits the application of filler material between adjacent, perpendicular, surfaces.

SUMMARY OF THE INVENTION

A simplified nozzle is provided which is adapted to supply filler material between the adjacent, perpendicular surfaces commonly found in a corner. The nozzle has a triangular spear shape which fits precisely in a corner area to be filled. The triangular shaped nozzle provides an equal bead flow of filler material to both sides of the corner area being filled. Such a nozzle permits the user to see the bead of filler material being applied to the corner surfaces. Moreover, this nozzle permits the user to pull the bead of filler material along the surface instead of pushing the bead when applying the filler material to the surface. By utilizing the triangular spear shaped nozzle of the present invention, the user is able to apply a perfect bead of filler material on a first pass and does not have to smooth or trim the bead.

The caulking nozzle of the present invention is further adapted to either replace or fit over existing nozzles on containers of filler material. The nozzle can be inserted into the opening provided at the end of a container of filler material by means of threads internally or externally applied to the base of the nozzle. The internal threads of the nozzle base are secured to an externally threaded member provided on the container of filler material. The external threads of the nozzle are to be secured to an internally threaded member provided on the container of filler material. Alternatively, the nozzle can be placed over an existing conical nozzle and provide the advantages set forth above.

DETAILED DESCRIPTION OF THE PREFERRED EMBODIMENTS

Figure 1:
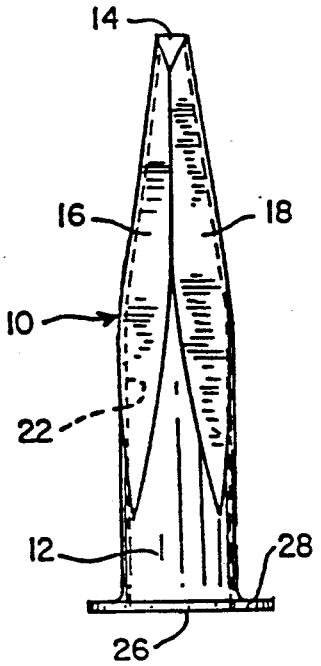
FIG. 1 is a front view of a preferred embodiment of the nozzle of the present invention.
Figure 2:
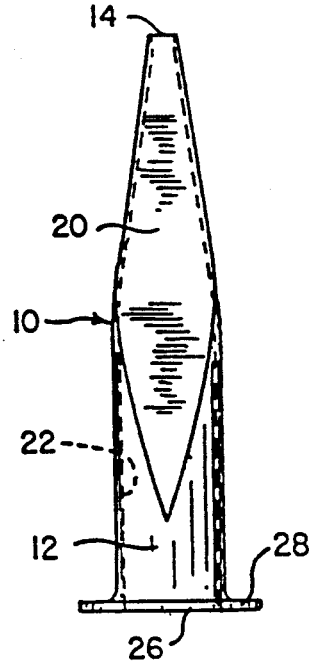
FIG. 2 is a back view of the nozzle of FIG. 1.

As shown in FIGS. 1 and 2, improved nozzle 10 includes cylindrical barrel portion 12 positioned axially opposite applicator tip 14. Three beveled surfaces 16, 18 and 20, create a taper to nozzle 10 extending from cylindrical barrel portion 12 to applicator tip 14. Preferably, applicator tip 14 is cut at a 45 degree angle relative to beveled surface 20. The lowest point of applicator tip 14 should be provided at the intersection of two beveled surfaces such as 16 and 18 as shown in FIG. 1. Central bore 22, extending from supply opening 26 to applicator tip 14, shown in chain line, is provided in nozzle 10 to create a hollow nozzle capable of transporting filler material therethrough. Central bore 22 is formed by the generally uniform wall thickness of nozzle 10. Although pre-cut to a desired opening size, applicator tip 14 can be made larger by the user if a larger bead of filler material is desired. Applicator tip 14 is made larger by cutting the applicator tip 14 at a position near supply opening 26. Flange 28 may be provided on the base of nozzle 10.

Preferably, the axial cross section of nozzle 10 provided by the intersection of surfaces 16, 18, and 20 forms an equilateral triangle. The shape of this equilateral triangle permits nozzle 10 to be closely applied between the adjacent, perpendicular surfaces and completely fill the space in a corner.

Figure 3:
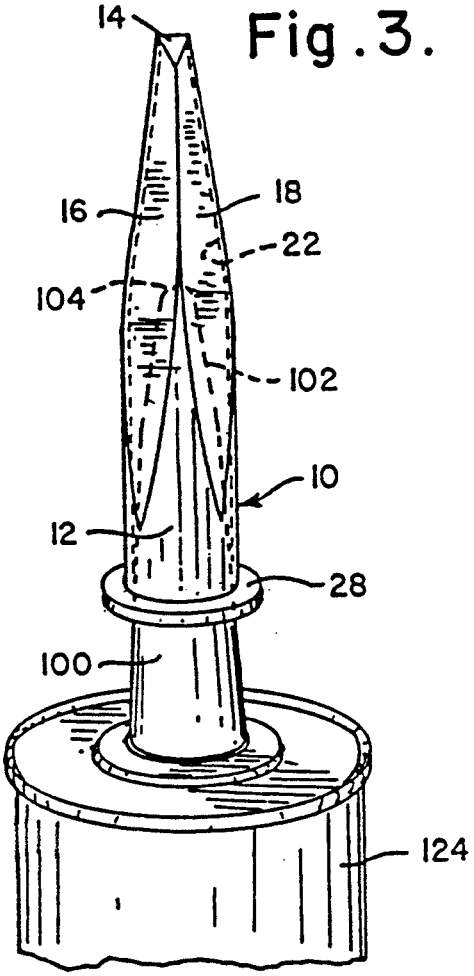
FIG. 3 is a perspective view of the nozzle of FIG. 1 slipped over an existing nozzle on a caulking container.

FIG. 3 shows an alternative embodiment for attaching my improved nozzle attached to a container of filler material. In the embodiment of FIG. 3, triangular spear-shaped nozzle 10 is fitted over existing nozzle 100 which is attached to container 124 of filler material. Existing nozzle 100 includes tapered end 102, shown in chain line, having applicator tip 104, also shown in chain line, provided at the end thereof. Nozzle 10 fits over existing nozzle 100 such that tapered end 102 of existing nozzle 100 is tightly fitted within central bore means 22 of nozzle 10. Filler material discharged through applicator tip 104 of existing nozzle 100 enters central bore means 22 of improved nozzle 10 and finally exits out applicator tip 14 of nozzle 10. As with the embodiment shown in FIGS. 1 and 2, surfaces 16 and 18 are provided against the corner surfaces to be filled. Flange 28 assists in securing and removing nozzle 10 from existing nozzle 100.

Figure 5:
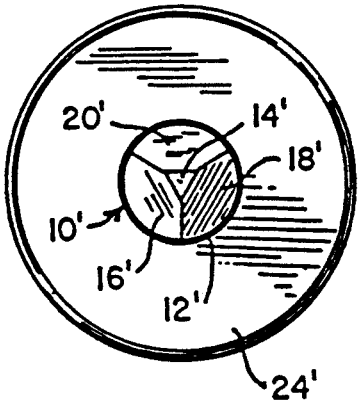
FIG. 5 is a top view of the nozzle and caulking container of FIG. 4.
Figure 4:
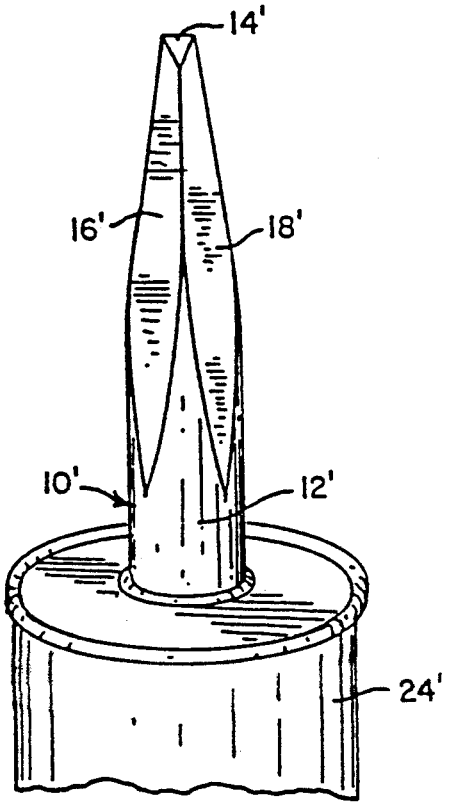
FIG. 4 is a perspective view of the nozzle of FIG. 1 attached directly to a caulking container.

FIGS. 4 and 5 show nozzle 10' attached to container 24' of filler material such as caulking compound. In such an arrangement, surfaces 16, and 18, are provided against the adjacent, perpendicular surfaces into which the filler material is to be supplied. Because of the triangular shape formed by beveled surfaces 16', 18' and 20', nozzle 10' fits precisely in such a corner area. The bead of filler material proceeds from container 24' through the central bore means and out applicator tip 14'. Nozzle 10' provides an equal bead flow of filler material to both sides of the area being filled. It has been found that nozzle 10' produces such a sufficiently smooth bead that the filler material can be applied to the corner can be in a pulling, rather than the suggested pushing, motion. This permits the user to more closely monitor the application of filler material to the surface being filled. I have found that nozzle 10' provides a perfect bead of filler material on the first pass, thereby eliminating the need to smooth the bead or trim the bead.

Nozzle 10' can be secured to filler material container 24' by applying either external or internal threads on the base of nozzle 10' near the supply opening. If container 24' includes a nozzle securing member which is internally threaded, corresponding external threads may be provided on barrel portion 12' to secure nozzle 10' to container 24'. If container 24' includes a nozzle securing member which is externally threaded, corresponding internal threads provided in the central bore 22 secure nozzle 10' to container 24'. Alternatively, a flange can be provided along the base of nozzle 10. The flange is sized to have a larger diameter than the nozzle opening provided in the top of container 24, The flange secures nozzle 10 to container 24' when nozzle 10' is inserted through the opening in container 24'.

By using the improved nozzle of the present invention, the user is able to see the bead of filler material being applied to the surface. The nozzle can be pulled instead of pushed to apply the bead of filler material.

In the foregoing specification certain preferred practices and embodiments of this invention have been set out. However, it will be understood that the invention may be otherwise embodied within the scope of the following claims.

I claim:

1. A nozzle for the distribution of filler material in a corner formed by the intersection of two generally perpendicular surfaces comprising barrell means having a tapered end, said barrel means having a cross-section area which continuously decreases toward said tapered end, said tapered end formed from three beveled surfaces, and central bore means extending longitudinally through the extent of said barrel means, said central bore means forming a supply opening and a tip opening, said tip opening provided at the intersection of said three beveled surfaces at said tapered end, said tip opening being provided at an angle of approximately 45° to a first of said three beveled surfaces and extending to the intersection of the other two of said three beveled surfaces, said other two beveled surfaces sized and positioned to fit within a corner formed by the intersection of said two generally perpendicular surfaces, said first of said three beveled surfaces adapted to smooth the flow of filler material from said nozzle.

2. The nozzle of claim 1 wherein the cross-section of said tapered end of said barrel means is an equilateral triangle.

3. The nozzle of claim 2 further comprising means adjacent to said supply opening for securing said nozzle to a container of filler material.

4. The nozzle of claim 2 further comprising means adjacent to said supply opening for securing said nozzle to an existing nozzle provided on a container of filler material.

5. The nozzle of claim 1 further comprising means adjacent to said supply opening for securing said nozzle to a container of filler material.

6. The nozzle of claim 1 further comprising means adjacent to said supply opening for securing said nozzle to an existing nozzle provided on a container of filler material.

* * * * *